US005730063A

United States Patent [19]

Forbes et al.

[11] Patent Number: 5,730,063

[45] Date of Patent: Mar. 24, 1998

[54] HIGH CAPACITY CONTAINER RAIL CAR FOR VARYING ARRANGEMENTS INTERMODAL CONTAINERS

[75] Inventors: James Wilfred Forbes, Waterloo; Ilario A. Coslovi, Burlington, both of Canada

[73] Assignee: National Steel Car Ltd., Ontario, Canada

[21] Appl. No.: 641,376

[22] Filed: Apr. 30, 1996

[51] Int. Cl.[6] ..... B61D 17/00

[52] U.S. Cl. ..... 105/355; 105/404

[58] Field of Search ..... 105/355, 396, 105/404, 407, 441, 413, 414, 416, 419, 420, 421

[56] References Cited

U.S. PATENT DOCUMENTS

| | | | |
|---|---|---|---|
| 4,589,348 | 5/1986 | Holabeck et al. | 105/420 |
| 4,599,949 | 7/1986 | Hill | 105/355 |
| 4,703,699 | 11/1987 | Hill | 105/355 |
| 4,862,810 | 9/1989 | Jamozy et al. | 105/355 |
| 5,279,230 | 1/1994 | Thomas et al. | 105/355 |
| 5,465,670 | 11/1995 | Butcher | 105/355 |
| 5,501,556 | 3/1996 | Butcher et al. | 105/355 |
| 5,520,489 | 5/1996 | Butcher et al. | 105/355 |

OTHER PUBLICATIONS

Husky–Stack 2+2, Greenbrier Intermodal, Gunderson, Inc. (no date).

*Primary Examiner*—Mark T. Le

*Attorney, Agent, or Firm*—Oldham & Oldham Co., LPA

[57] ABSTRACT

A railroad freight car for transporting intermodal cargo containers. The railroad freight car comprises a structural frame having spaced apart side structures, opposing end structures and a floor structure. The side structures each have a top member and a bottom member disposed in a spaced apart relationship and extending longitudinally between the opposing end structures. The floor structure is disposed to extend between the respective bottom members of each side structure. The end structures each provide an inboard bulkhead, such that the side structures, floor structure and bulkheads together define a well for receiving an intermodal cargo container. The end structure further provides a longitudinally disposed stub centre sill having an outboard end for receiving a coupling means for coupling the railroad freight car to another railroad car. The stub centre sill defines a draft centerline positioned above the railhead at a predetermined height A. The end structure has a transversely disposed structural member connected to each of the top members of the side structure. The uppermost surface of each of the top members is positioned above the draft centerline at a height B such that the ratio defined by the said height A divided into the said height B is greater than approximately 1. The freight car is capable of carrying various configurations of intermodal cargo containers, for instance, four 20-foot containers in a double-stacked arrangement.

17 Claims, 16 Drawing Sheets

HIGH CAPACITY CONTAINER RAIL CAR FOR VARYING ARRANGEMENTS INTERMODAL CONTAINERS

FIELD OF INVENTION

This invention relates to a railroad freight car for carrying intermodal cargo containers. In particular, this invention relates to a versatile freight car having an improved support structure and which is capable of carrying various configurations of intermodal cargo containers, for instance, four 20-foot containers in a double-stacked arrangement.

BACKGROUND OF INVENTION

The prior art has provided a variety of freight cars adapted to carry intermodal cargo containers. Typically, the maximum length of trains in the North American railroad system is approximately 6000 feet. The double-stacking of containers makes it possible to maximize the number of cargo containers for a given train length. In order to clear bridges and tunnels, various types of container cars having a low profile have been designed. One type of container car in use is referred to as a well car since it has a container-receiving well portion or space between trucks supporting each end of the well car. The body of the car is generally at a low height with containers in the bottom tier of the double-stacked container arrangement supported approximately 10 inches above the rail in a loaded car. In order to comply with the clearance requirements above the rail, the body deflection at the centre of the car must be limited. This is achieved by increasing the stiffness of the structure. This can be achieved by either increasing the weight or by employing more structurally efficient design concepts.

The various sizes of standard wheels and axles prescribe the gross rail load limits so minimizing the tare weight is economically important because reduced tare weight permits increased load limits by an equal amount. Thus manufacturers are under constant pressure to develop more structurally efficient designs which are stiff, stable, vibration resistant, fatigue resistant and have ample strength. The well car must withstand the various static and dynamic forces which act upon the cargo containers during transport, which tend to be greater on some parts of the structure in a double-stacked arrangement.

Furthermore, the car design must respect the functional requirements imposed by the current infrastructure, technologies and practices. In particular, the well car must be designed such that containers can be loaded into and unloaded from the well portion of the car by an operator or average skill using conventional loading equipment.

At the same time, in order to achieve maximum utility, the well car must also be able to accommodate as many different lengths and widths of containers as possible, and to efficiently bear the loads associated with those containers. Intermodal cargo containers come in different but standardized lengths and widths. The lengths most widely used are 20, 40, 48 and 53 feet, while the widths most widely used are 8 and 8.5 feet, and the heights are either 8.5 feet or 9.5 feet. Each cargo container has a different total load capacity. For example, the total load capacity of typical 20-foot cargo containers is approximately 52,900 pounds, while the total load capacity of typical 40-foot or 48-foot cargo containers is approximately 67,200 pounds.

U.S. Pat. No. 5,465,670 issued to Butcher on Nov. 14, 1995 and assigned to the applicant herein discloses an improved railroad freight car for transporting double-stacked containers up to a maximum load of approximately 173,000 pounds. That car has seen substantial commercial use and has performed very well. However, it was not designed to transport four 20-foot cargo containers in a double-stacked arrangement up to a maximum load of approximately 286,000 pounds. Additionally, it was not found efficient or cost effective to simply scale up the structure of the existing car to strengthen it to carry loads of approximately up to 225,000 pounds.

Hence there is a need for an improved low-profile, low deflection, minimal tare weight well car capable of accommodating intermodal cargo containers of standard dimensions in a double-stacked configuration. More specifically, there is a need for a well car of this variety which is capable of transporting four 20-foot containers having a maximum load of approximately 225,000 pounds in a double-stacked configuration. There is also a need to provide a well car of this variety which is designed so that an operator of average skill using conventional loading equipment can load and unload cargo containers without undue difficulty.

SUMMARY OF INVENTION

According to a broad aspect of the present invention, there is provided a railroad freight car for transporting intermodal cargo containers, the railroad freight car comprising a structural frame having spaced apart side structures, opposing end structures and a floor structure. The side structures each have a top member and a bottom member disposed in a spaced apart relationship and extending longitudinally between the opposing end structures. The floor structure extends between the respective bottom members of each side structure. The end structures each provide an inboard bulkhead, such that the side structures, floor structure and bulkheads together define a well for receiving an intermodal cargo container. The end structure further provides a longitudinally disposed stub centre sill having an outboard end for receiving a coupling means for coupling the railroad freight car to another railroad car. The stub centre sill defines a draft centerline positioned above the railhead at a predetermined height A measured from railhead to draft centerline. The end structure has a transversely disposed structural member connected to each of the top members of the side structure. The uppermost surface of each of the top members is positioned above the draft centerline at a height B measured from draft centerline to said uppermost surface, such that the ratio defined by the said height A divided into the said height B is greater than approximately 1. In other words, the ratio of B divided by A, or B/A, is greater than approximately 1.

With reference to preferred embodiments of the present invention the ratio defined by the height A divided into the height B is greater than 1, but less than 1.25, and preferably is approximately equal to 1.125. The top members and the bottom members of the side structures are each elongate straightline chords. The top and bottom elongate chords are disposed in a substantially parallel relationship, and the top chord has a generally rectangular cross-sectional configuration.

The side structure comprises a plurality of generally vertically disposed members connected between the top and bottom chords thereof, and a planar sidewall whose upper edges are connected to a vertical surface of each of the top and bottom chords which faces inwardly of the railroad freight car. The vertically disposed members of the side structures may be generally U-shaped channels whose free terminal longitudinal edges are attached to the planar sidewall, which may be a plate.

Where the transversely disposed structural member is an upper bolster, the end structure comprises a horizontally disposed shear plate, the shear plate extending between the side structures and connecting to the respective sidewalls thereof and having an upper surface to which the upper bolster is attached and a lower surface forming a top surface of the centre sill. In such an embodiment, an upper terminal edge of the inboard bulkhead, which is substantially planar and extends between the side structures to connect to the respective sidewalls, depends from an inboard terminal edge of the shear plate. Each side structure provides a generally vertically disposed web located adjacent each bulkhead and being substantially co-planar therewith. The web extends laterally outwardly of the railroad freight car and longitudinally between the top and bottom chords of the side structure to connect at each end therewith. The web is connected to the sidewall along an inwardly facing longitudinal edge of the web. Each side structure further provides a generally vertically disposed flange connected to the outwardly facing longitudinal edge of the web and having one terminal end thereof connected to the top chord.

The railroad freight car may be provided with a railroad truck for each of the end structures thereof, for instance a 110 ton railroad truck. Where the railroad freight car is provided with a 110 ton railroad truck, the railroad freight car has a tare weight of less than approximately 70,000 pounds, preferably approximately 60,600 pounds. Where the railroad freight car has a tare weight of 60,600 pounds, the railroad freight car may have a net load-carrying capacity of at least approximately 225,000 pounds.

BRIEF DESCRIPTION OF THE DRAWINGS

For purposes of illustration, but not of limitation, preferred embodiments of the present invention will next be described with reference to the following drawings, in which.

DETAILED DESCRIPTION OF PREFERRED EMBODIMENTS

Figure 1:
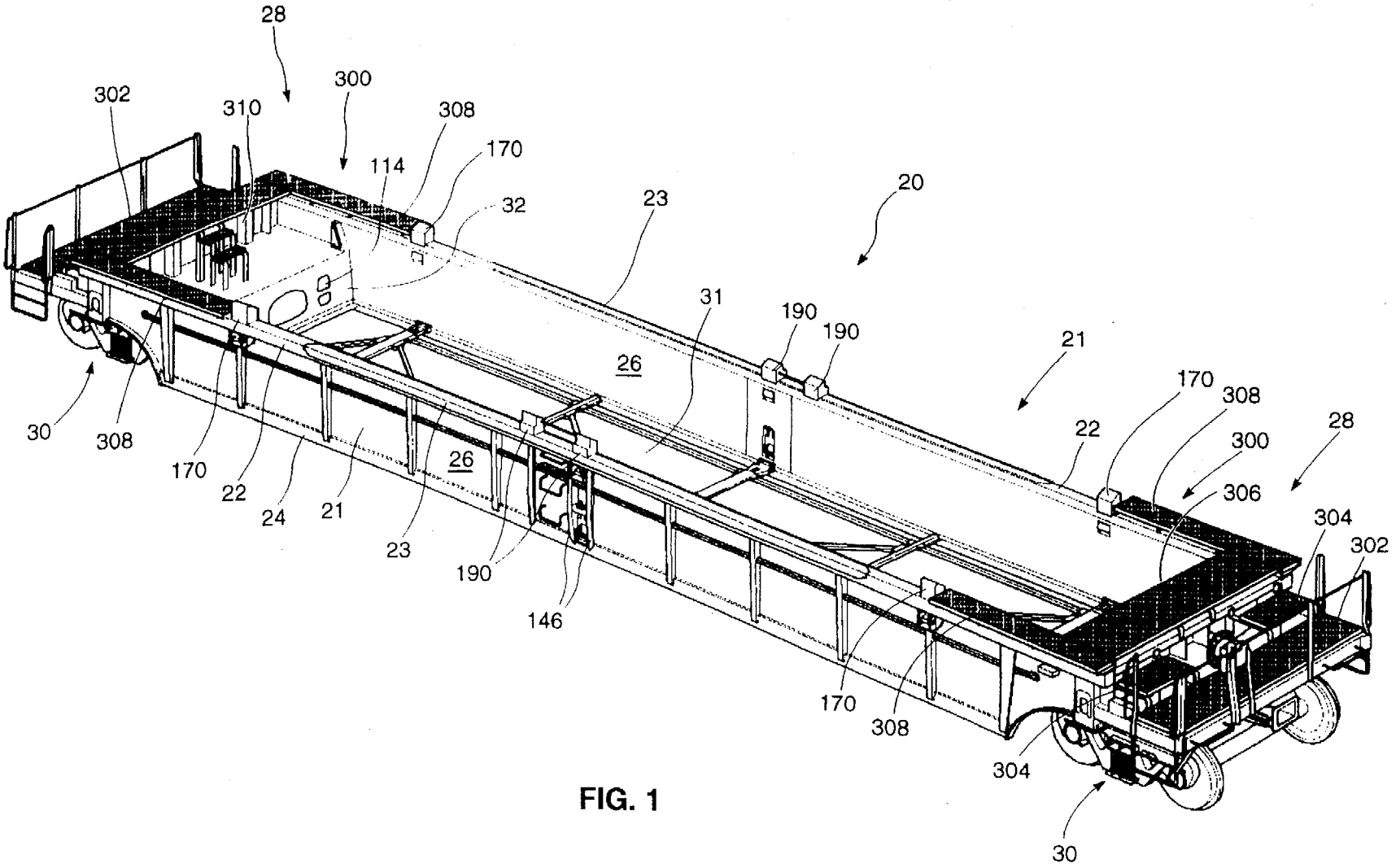
FIG. 1 is a perspective view of the railroad car of the present invention.
Figure 3:
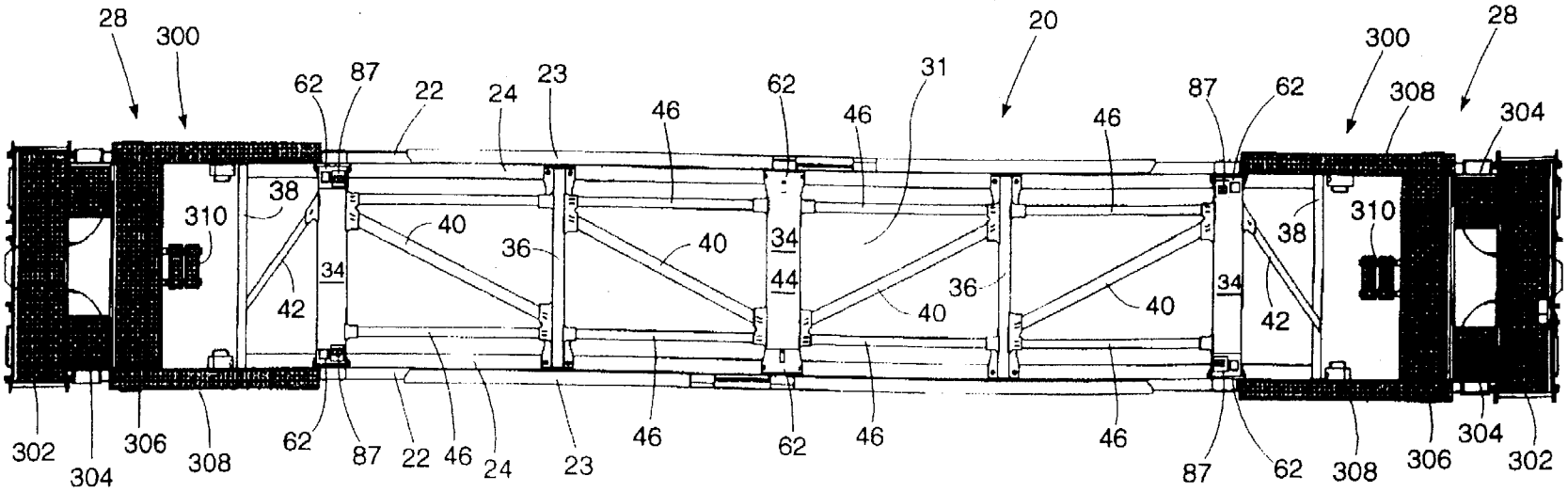
FIG. 3 is a top plan view of the railroad car of FIG. 1.
Figure 2:
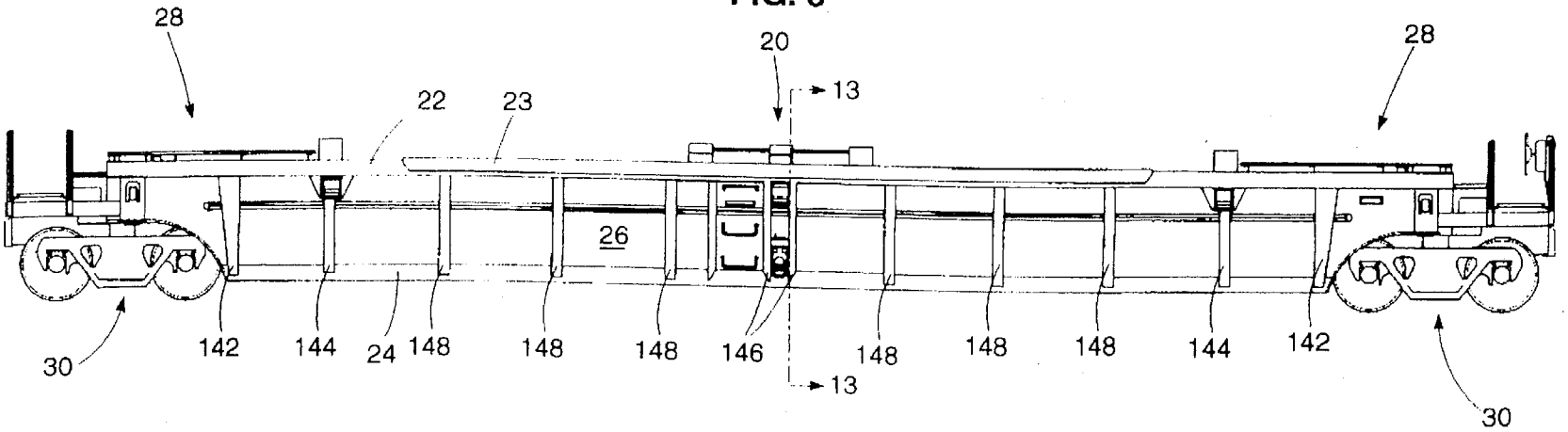
FIG. 2 is a side elevational view of the railroad car of FIG. 1.

The railroad freight car of the present invention for transporting double-stacked intermodal cargo containers is illustrated in FIGS. 1, 2 and 3 as 20. In the preferred embodiment, the car 20 has a net load carrying capacity of at least approximately 225,000 pounds. Certain aspects of the freight car are constructed in accordance with standard practice, in that the car has a longitudinally extending load bearing frame structure formed by spaced apart side structures 21 comprising a top member, (such as top side chords 22), a bottom member, (such as bottom side chords 24) and sidewalls 26 and by opposing end structures 28. The frame structure is supported at its ends on trucks 30 which run on railway tracks. In the preferred embodiment, the car 20 is supported by two 110 ton trucks. The side structures 21, inboard bulkheads 32 and a floor structure 31 define a well for receiving the intermodal cargo containers. The railroad freight car of the present invention has a relatively low tare weight of less than approximately 70,000 pounds, namely approximately 60,600 pounds.

(a) Floor

As shown in FIG. 3, the floor structure 31 of the well extends between parallel, spaced apart bottom side chords 24 and comprises load supporting transverse members 34, intermediate transverse members 36, and bulkhead bottom flanges 38. Transverse members 34 and 36 are preferably connected to the bottom side chord by bolts. Extending between adjacent transverse members are diagonal struts 40 and diagonal end struts 42 which are arranged in a symmetrical layout about the centre load supporting transverse member shown in FIG. 3 as 44. Diagonal struts 40 are approximately parallel to each other on either side of the centre load supporting transverse member 44, but are symmetrically opposed with respect to the corresponding struts 40 located on the opposite side of the centre load supporting member 44. Diagonal end struts 42 each extend between the longitudinally outermost transverse members 34, which are immediately adjacent the end structures 28, and the bulkhead bottom flanges 38. The diagonal end struts 42 extend generally diagonally from a position laterally adjacent the connection of a diagonal strut 40 with the transverse member 34 immediately adjacent the end structure 28, to thereby join with the bulkhead bottom flanges 38.

Figure 7A:
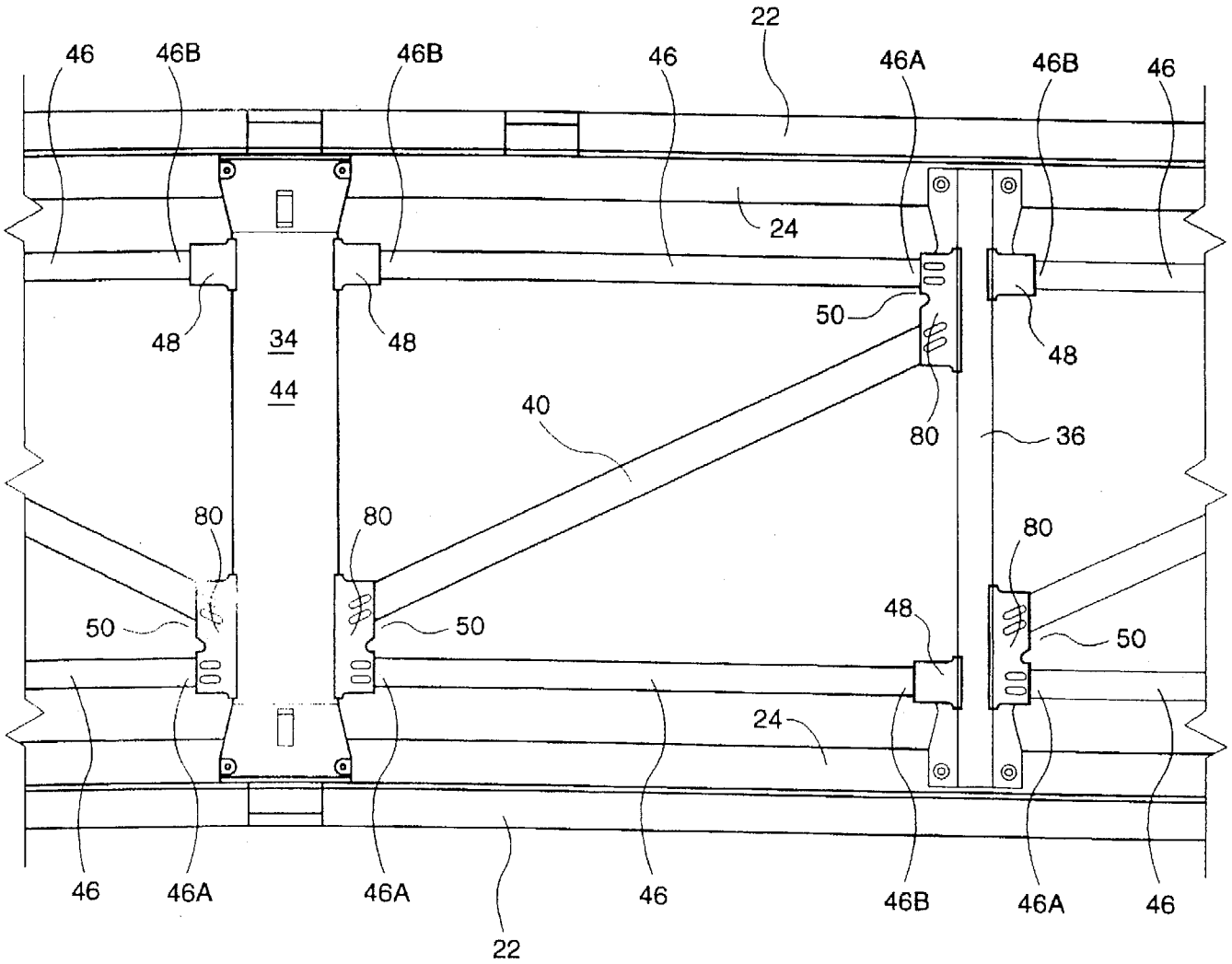
FIG. 7*a* is a detailed top plan view of a longitudinally inner section of the floor structure of FIG. 3.

Since the floor of the well is open, safety regulations require that some support be provided in the event that the bottom of the cargo container falls out or is otherwise compromised. Safety struts 46 are provided to support the cargo container load in such event. Safety struts 46 therefore extend longitudinally between load supporting transverse members 34 and intermediate transverse members 36 to serve this purpose. The safety struts 46 are hollow structural tubes of rectangular cross-section. As shown in FIG. 7*a*, one connected end of the safety strut 46 is rigidly connected 46A while the opposite connected end 46B is slidingly mounted. In the preferred embodiment, safety struts 46 are welded into a bracket assembly 50 at one end, as is described herein below, and slip jointed to a bracket 48 at the other.

Figure 7C:
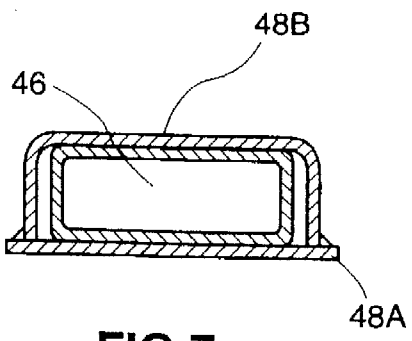
FIG. 7*c* is a sectional view of a slip joint connection between a transverse member and a safety strut, taken along view lines 7*c*–7*c* in FIG. 7*b;*
Figure 7B:
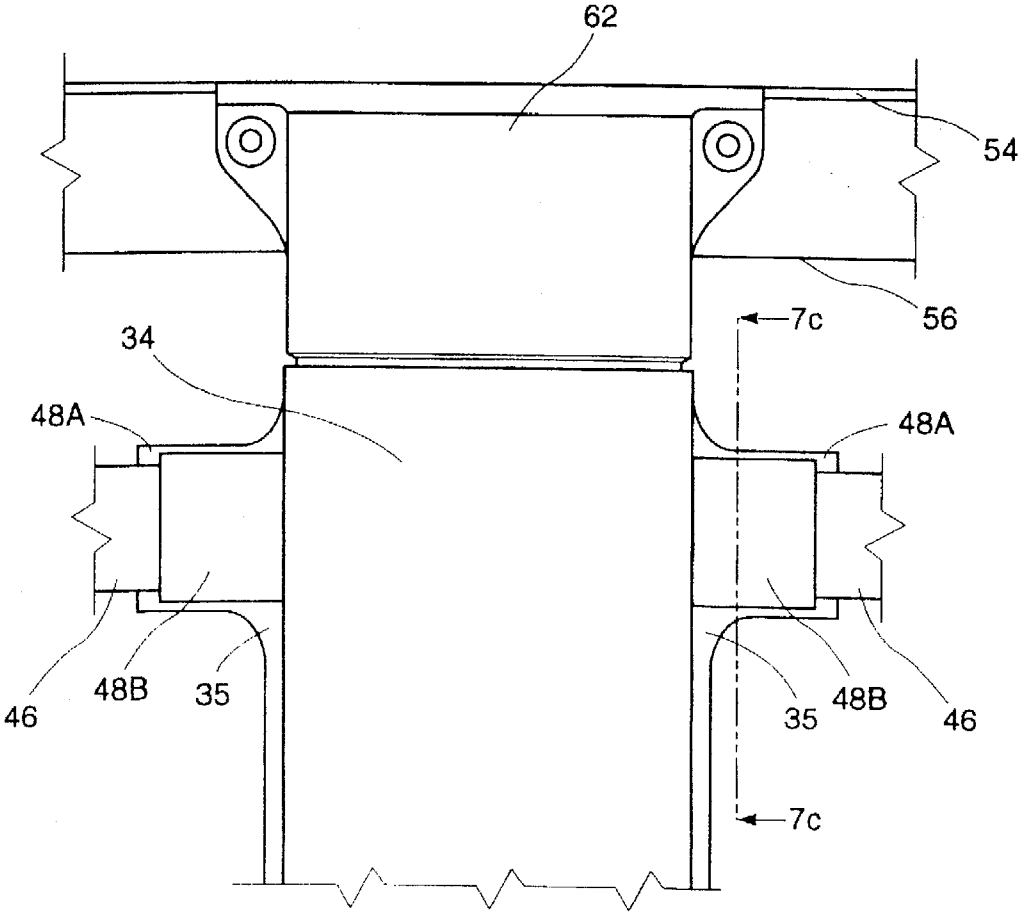
FIG. 7*b* is a detailed top plan view of one terminal end of the centre load supporting transverse member, showing two slip jointed connections between the transverse member and two safety struts.

Bracket 48 is best illustrated in FIGS. 7*b* and 7*c*. Bracket 48 comprises a bottom plate 48A and a cap 48B. Bottom plate 48A is joined to a transverse member 34 or 36. Cap 48B is a bent plate formed into a U-pressing which is attached, for example by a weld, along its free longitudinal ends to the bottom plate 48A. The terminal end of the safety strut 46 is captured between the cap 48B and the bottom plate 48A (as is best illustrated in FIGS. 7*b* and 7*c*), but is free to slide longitudinally. In the preferred embodiment, bottom plate 48A is integral with the transverse member 34 or 36 and preferably is an extension 35 of the bottom surface of the transverse member 34 or 36. The purpose of the slip joint at bracket 48 is to prevent the development of axial loads in the safety struts 46 when the bottom side chords 24 are strained. The welded end is thus protected from high fatigue inducing loads.

The combination of opposed diagonal struts and transverse members described above produces a relatively lightweight and rigid floor structure of the freight car, which is not only designed to connect the two sides of the car, but also to resist the lateral container loads applied at the centre of the car. These loads are inertia loads from the lateral motion of the car.

Figure 4:
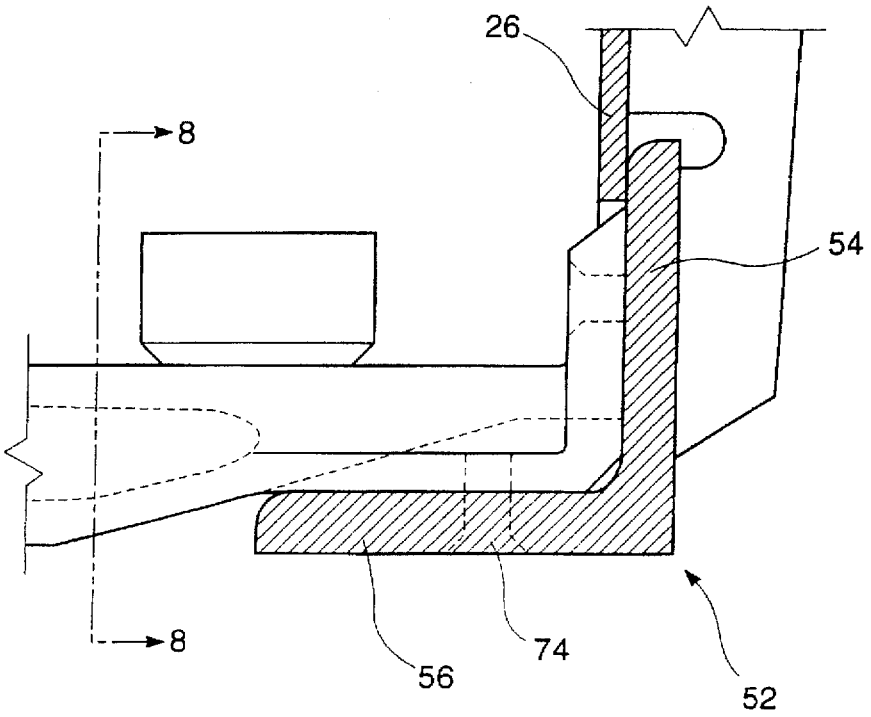
FIG. 4 is a transverse sectional view of the connections between a container support bracket for a load supporting transverse member, and respectively, the bottom side chord and the bottom sidewall of the railroad car of FIG. 1.
Figure 6A:
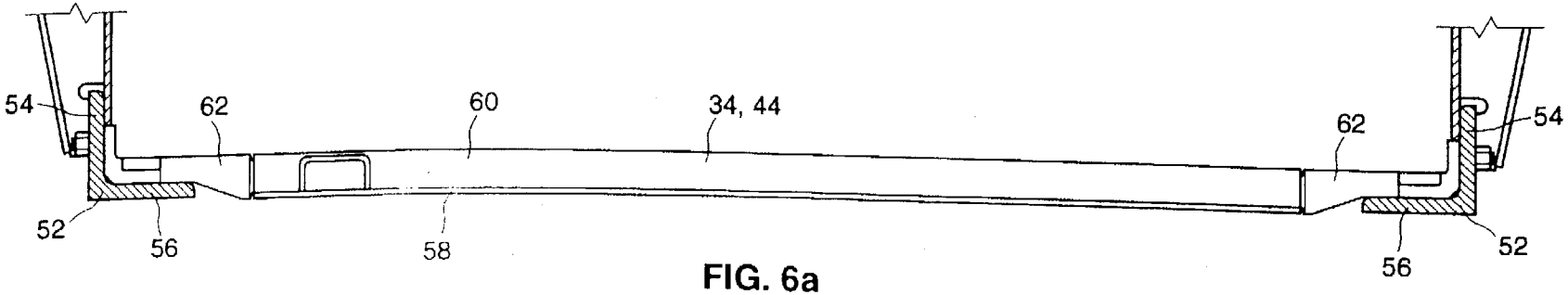
FIG. 6*a* is a sectional view of the load supporting transverse member of the railroad car of FIG. 1, located at the centre of the car.

As best illustrated in FIG. 4, in the preferred embodiment, each bottom side chord 24 is a rolled angle 52 having a vertical leg 54 and a horizontal leg 56. Vertical leg 54 is welded to a sidewall 26. As shown in FIGS. 6*a* and 6*c*, the load supporting transverse members 34 comprise a bottom plate 58 and a top flange in the form of a U-pressing 60 welded thereto. The free longitudinal ends of U-pressing 60 are joined to the bottom plate 58. The load supporting transverse members 34 also comprise a container support bracket 62 at each longitudinal end as shown in FIGS. 6*a* and 6*c*.

Figure 5:
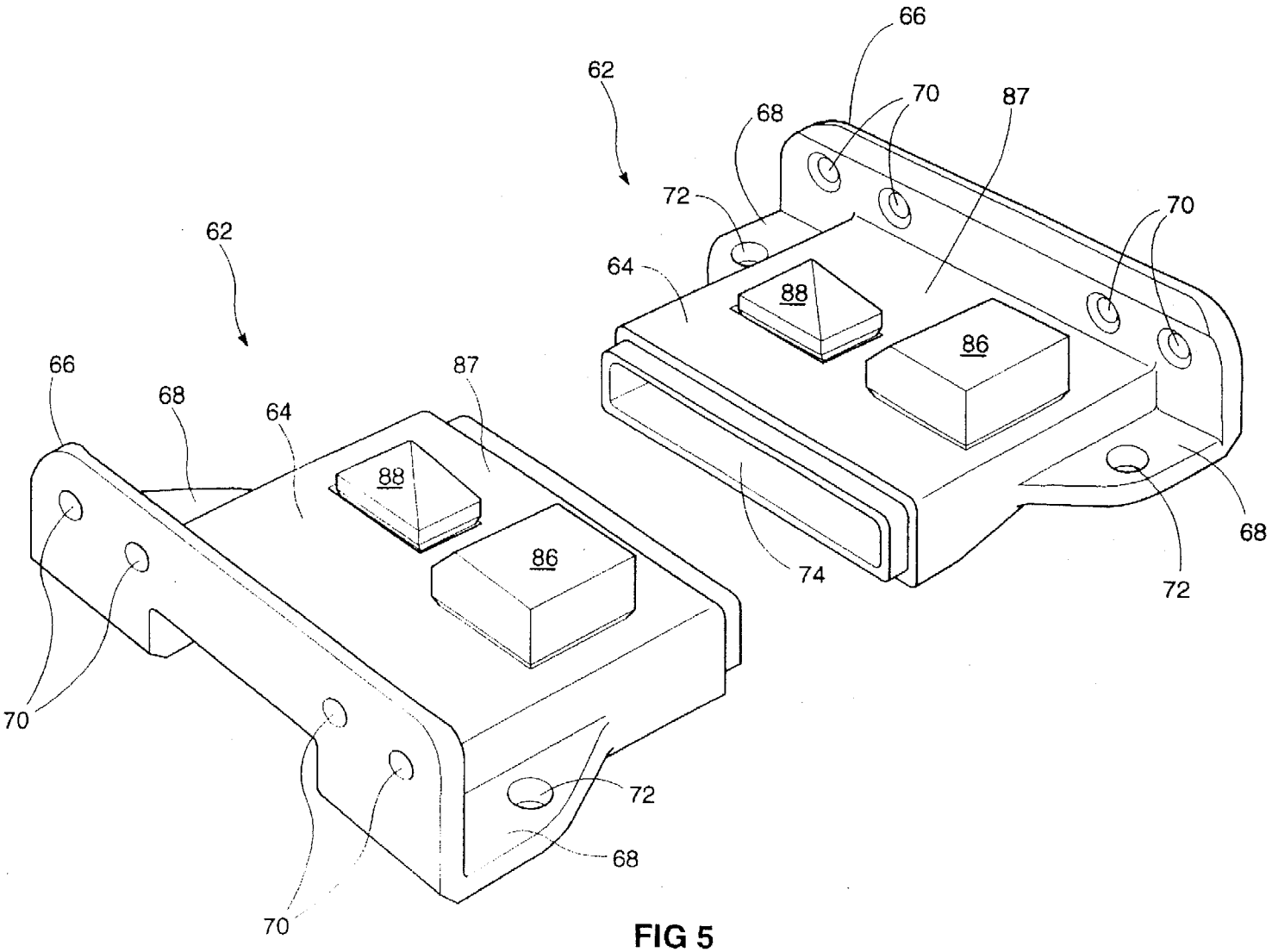
FIG. 5 is a perspective view of a pair of container support brackets with container support assemblies for connecting the load supporting transverse members.

Referring to FIG. 5, container support bracket 62 has a horizontal platform 64, having a flange 66 at one end extending perpendicular thereto and merging with a horizontal flange 68 on each side thereof. Referring to FIG. 4, 6*a* and 6*c*, container support bracket 62 is profiled to sit on the horizontal leg 56 of bottom side chord 24. Referring again to FIG. 5, flanges 66 and 68 have bolting holes 70 and 72, respectively, extending therethrough. The bolting holes 70 in flange 66 are preferably countersunk in order to maximize the width in the well for the containers. The horizontal leg 56 of bottom side chord 24 has bolting holes 74 (shown in dotted lines in FIG. 4) to correspond with bolting holes 72 in the horizontal flange 68 of container support bracket 62. Bolting holes 74 are countersunk so that the bolts are flush with the bottom surface of the horizontal leg 56 of bottom side chord 24.

Referring again to FIG. 5, the end of container support bracket 62 opposite the flange 66 is a hollow 74. The mouth of the hollow 74 is narrowed to fit inside of hollow transverse member 34 and to provide backing for a weld joint. Container support bracket 62 can be cast, forged or machined, but is preferably cast. In order to maximize the strength and stiffness of transverse members 34, the container support bracket 62 is of a depth such that the bottom of container support bracket 62 is flush with the bottom surface of the horizontal leg 56 of bottom side chord 24, as shown in FIGS. 4, 6*a* and 6*c*.

During assembly, a transverse member 34 is welded to container support brackets 62 at each end thereof. The container support brackets 62 are then bolted to both the vertical leg 54 and horizontal leg 56 of bottom side chord 24. The bolted connections provide for a fatigue resistant design.

Figure 6B:
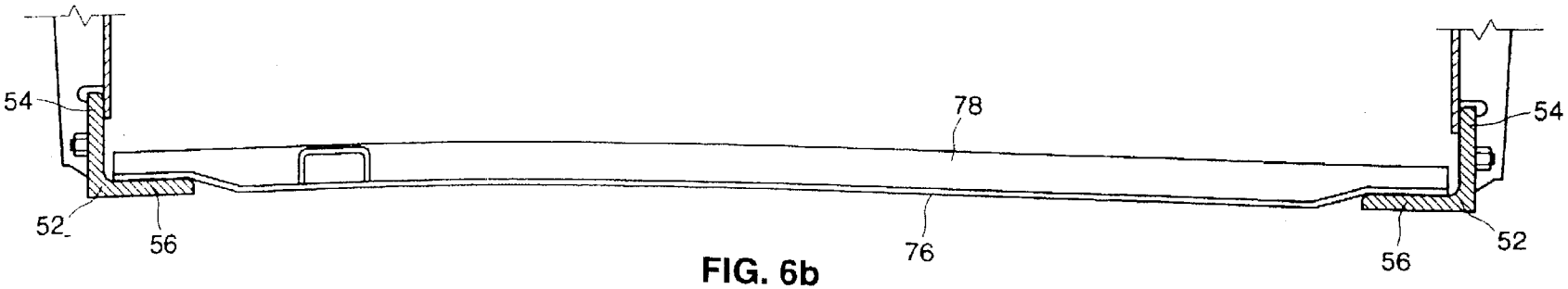
FIG. 6*b* is a sectional view of an intermediate transverse member of the railroad car of FIG. 1.
Figure 6C:
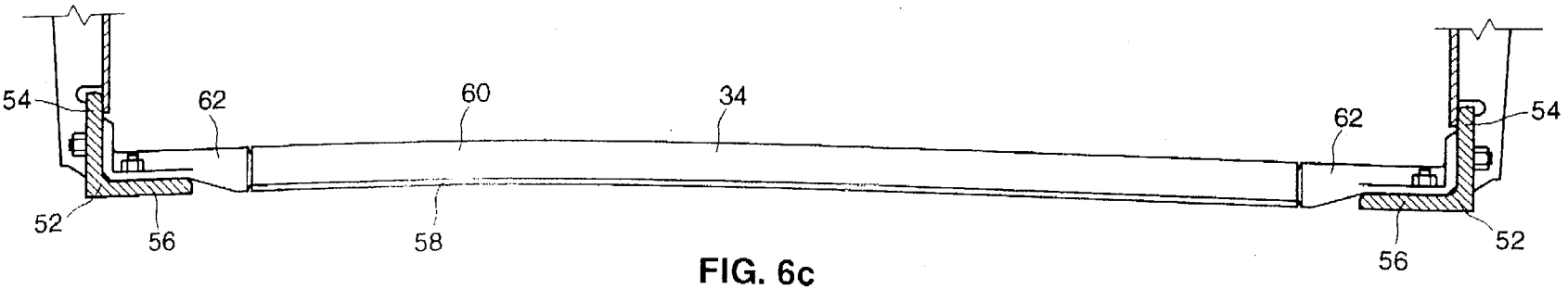
FIG. 6*c* is a sectional view of a load supporting transverse member of the railroad car of FIG. 1 located other than at the centre of the car shown without the container support assemblies, for clarity.

In the preferred embodiment as shown in FIG. 6*b*, the intermediate transverse members 36 also comprise a bottom plate 76 and a U-pressing top flange 78 welded thereto. Both the bottom plate 76 and U-pressing top flange 78 are profiled so that the bottom plate 76 can sit on top of the horizontal leg 56 of the bottom side chord 24, while maintaining a deeper section through the centre portion for strength and stiffness. The bottom flange 76 has bolting holes (not shown) for bolting to the horizontal leg 56 of the bottom side chord 24. During assembly, the intermediate transverse member 36 is bolted to the horizontal leg 56 of bottom side chord 24.

Diagonal struts 40 and diagonal end struts 42 are hollow structural tubes of rectangular cross section. In the preferred embodiment, both the welded end of safety strut 46 and the adjacent end of diagonal strut 40 are joined to a transverse member 34 or 36 by a single bracket assembly 50, as best illustrated in FIG. 7*a*. In the preferred embodiment, the bracket assembly 50 comprises a ledge (not shown) for a bottom and an attachment plate 80 for a top. The bottom plate 58 or 76 of the load supporting transverse members 34 or the intermediate transverse members 36, respectively, is profile burned to form the ledge on which the diagonal strut 40 and for the adjacent terminal end of the safety strut 46 rest. Both the diagonal strut 40 and the welded end of the safety strut 46 are joined to the transverse member 34 or 36 with a single profile burned attachment plate 80 having slots 84, as is best illustrated in FIG. 7*a*. During assembly, the diagonal struts 40 and the safety strut 46 are fillet-welded on the top to the attachment plate 80 through slots 84 and groove-welded on the bottom to the bottom plate 58 or 76 of the transverse member 34 or 36, respectively. A reader skilled in the art will recognize that diagonal strut 40 and safety strut 46 need not be joined to a transverse member 34 or 36 by a single assembly 50, but may also be joined to a transverse member 34 or 36 by more than one similar assembly.

Figure 8:
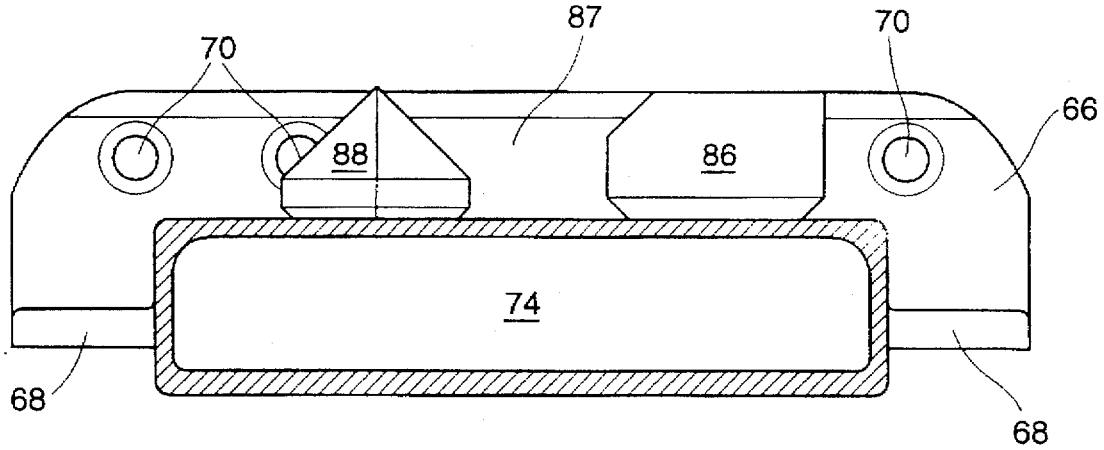
FIG. 8, located on the same sheet as FIG. 4, is a sectional view of the container support bracket of FIG. 4 taken along the view lines 8—8.
Figure 10A:
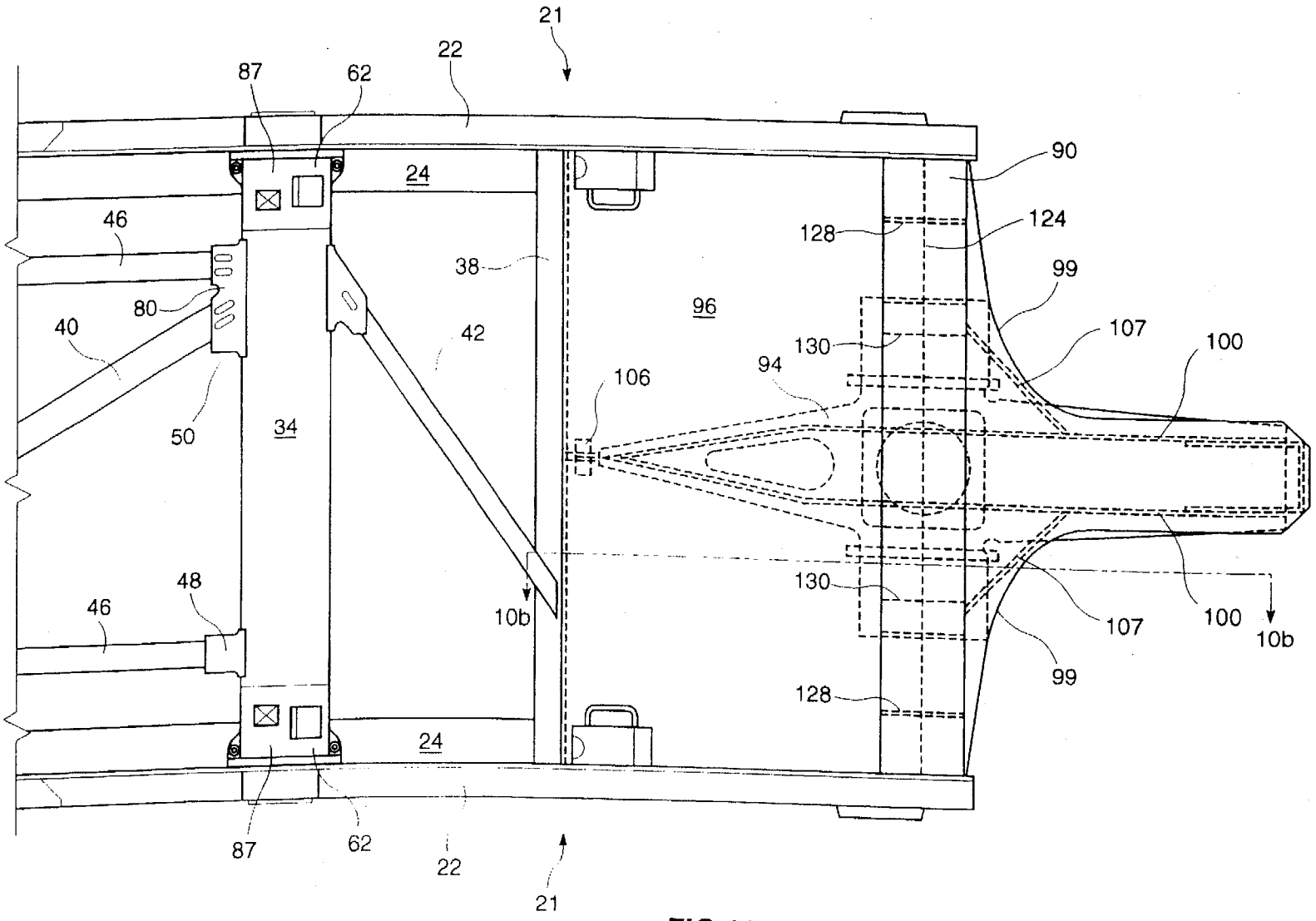
FIG. 10*a* is a top plan view of the railroad car as depicted in FIG. 9.

On each container support bracket 62 of the longitudinally outermost transverse members 34 is a container support assembly 87 as shown in FIGS. 3 and 10*a*. Detailed drawings of such container support assemblies 87 are provided in FIGS. 5 and 8. The container support assemblies 87 are located with respect to one another and to the container well such that the corner castings of properly placed 40-foot containers will rest upon them. The corresponding structural members in longer containers such as 45-foot or 48-foot containers are not located at the corners of the container, but are located to rest upon the container support assemblies. Each container support assembly 87 has mounted upon it a container guide 86 and a locating cone 88 (FIG. 5). The locating cone 88 is adapted to be received in an opening in a corner casting or a corresponding structural member in a container. The container guide 86 guides a container longitudinally during loading of the container into the well and onto the corresponding locating cone 86 on the container support assembly 87.

(b) End Structures

Figure 9:
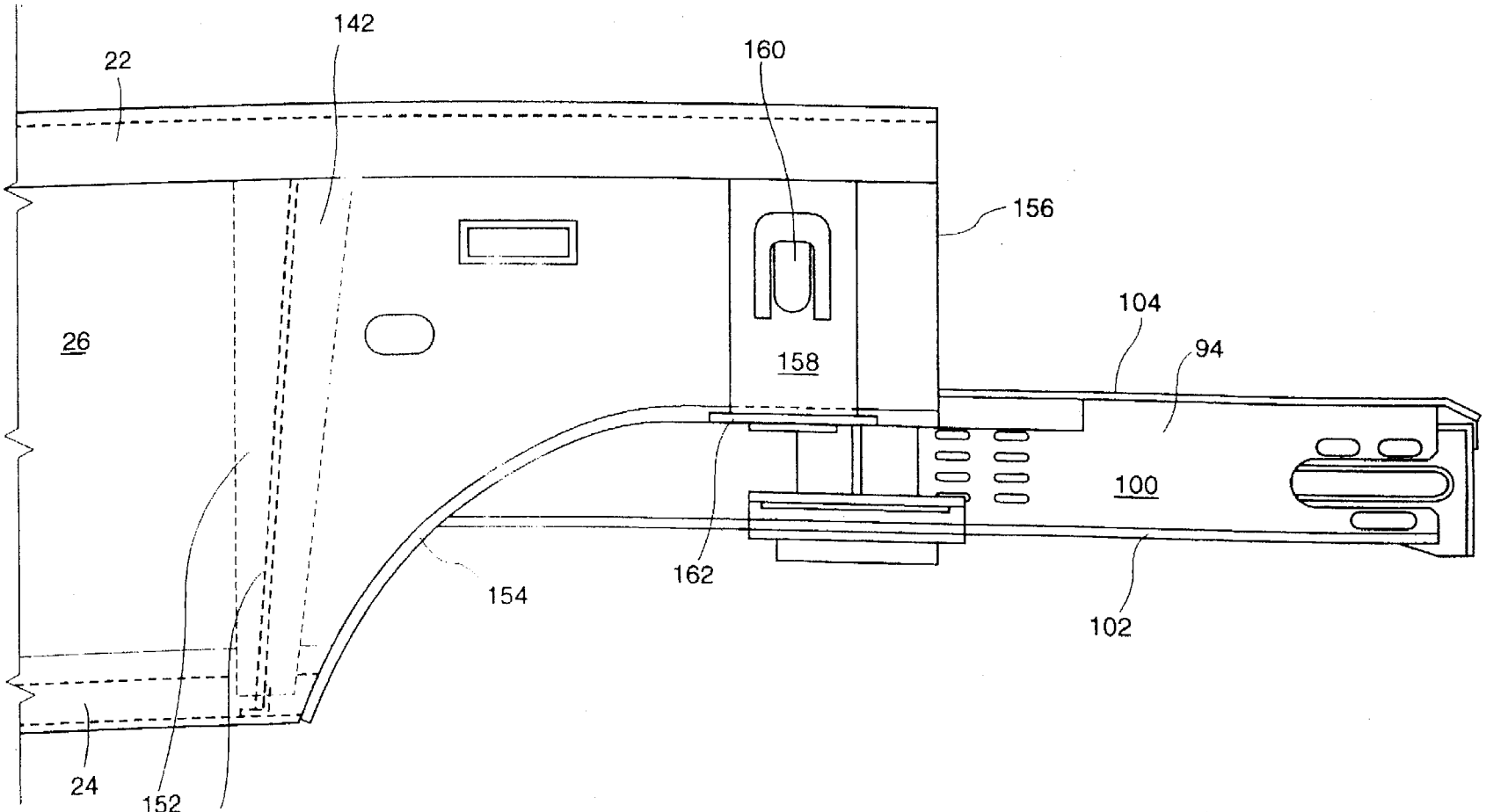
FIG. 9 is a detailed side elevational view of one end of the railroad car similar to the view of FIG. 2, shown without (i) the railings and platform and step arrangement; and (ii) the truck, for greater clarity.
Figure 10B:
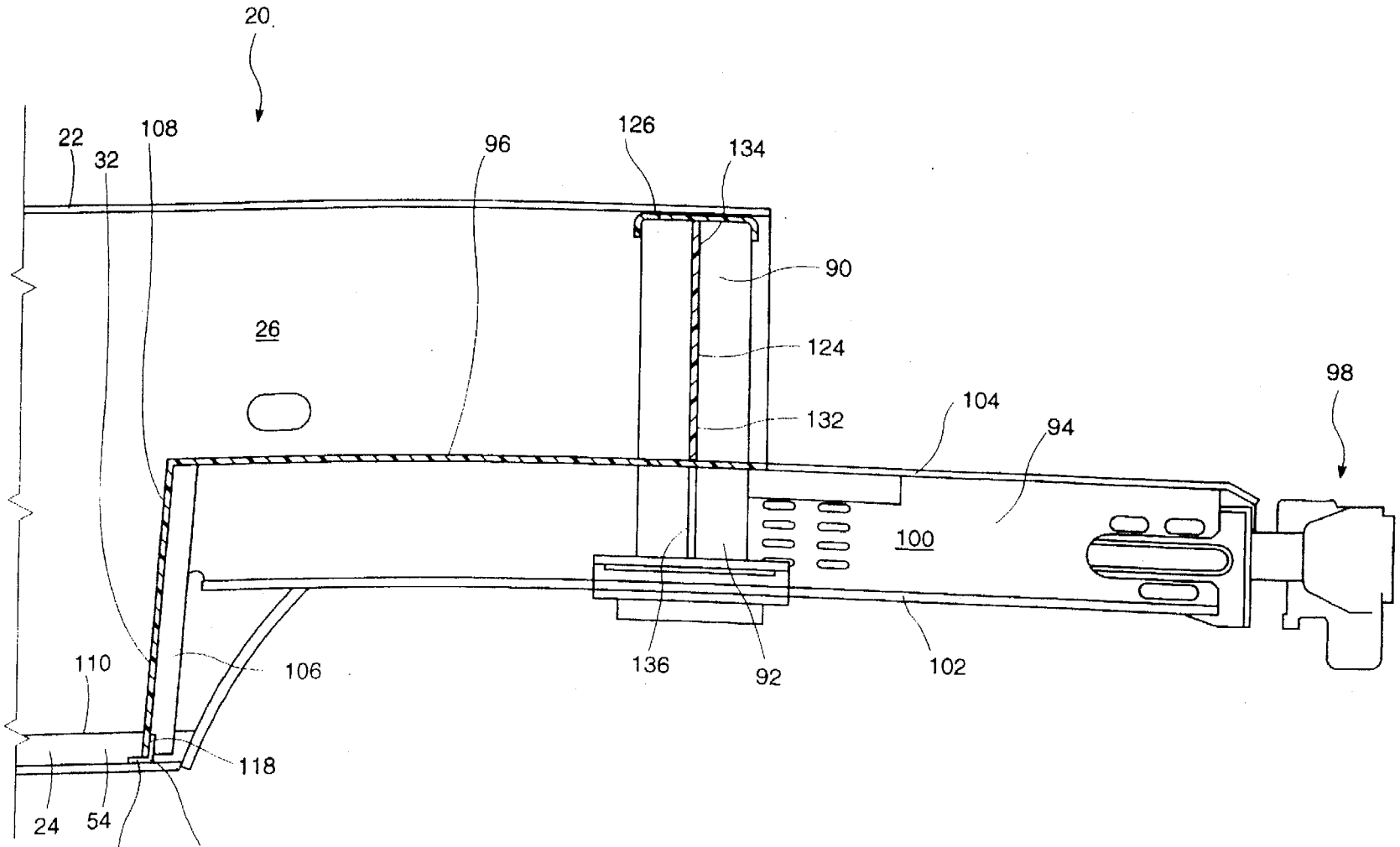
FIG. 10*b* is a detailed side sectional view of the railroad car depicted in FIG. 10*a,* taken along view line 10*b*–10*b,* shown with a coupler.
Figure 11:
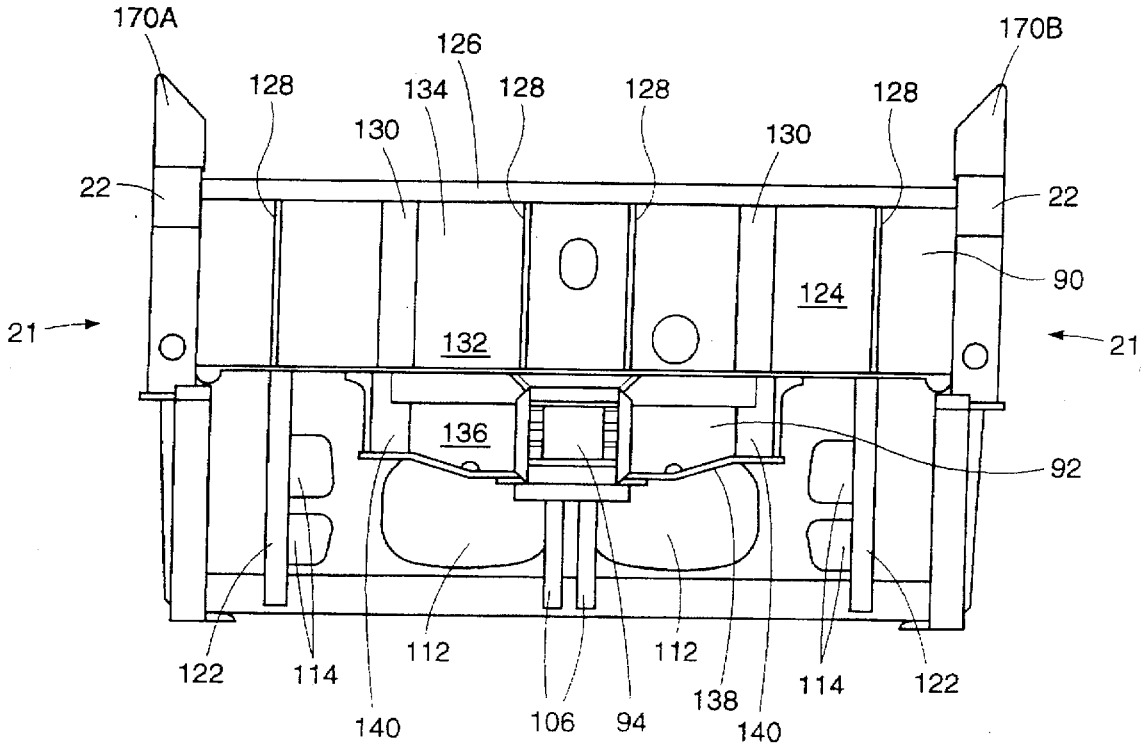
FIG. 11 is an end elevational view of the railroad car as depicted in FIG. 9.
Figure 12A:
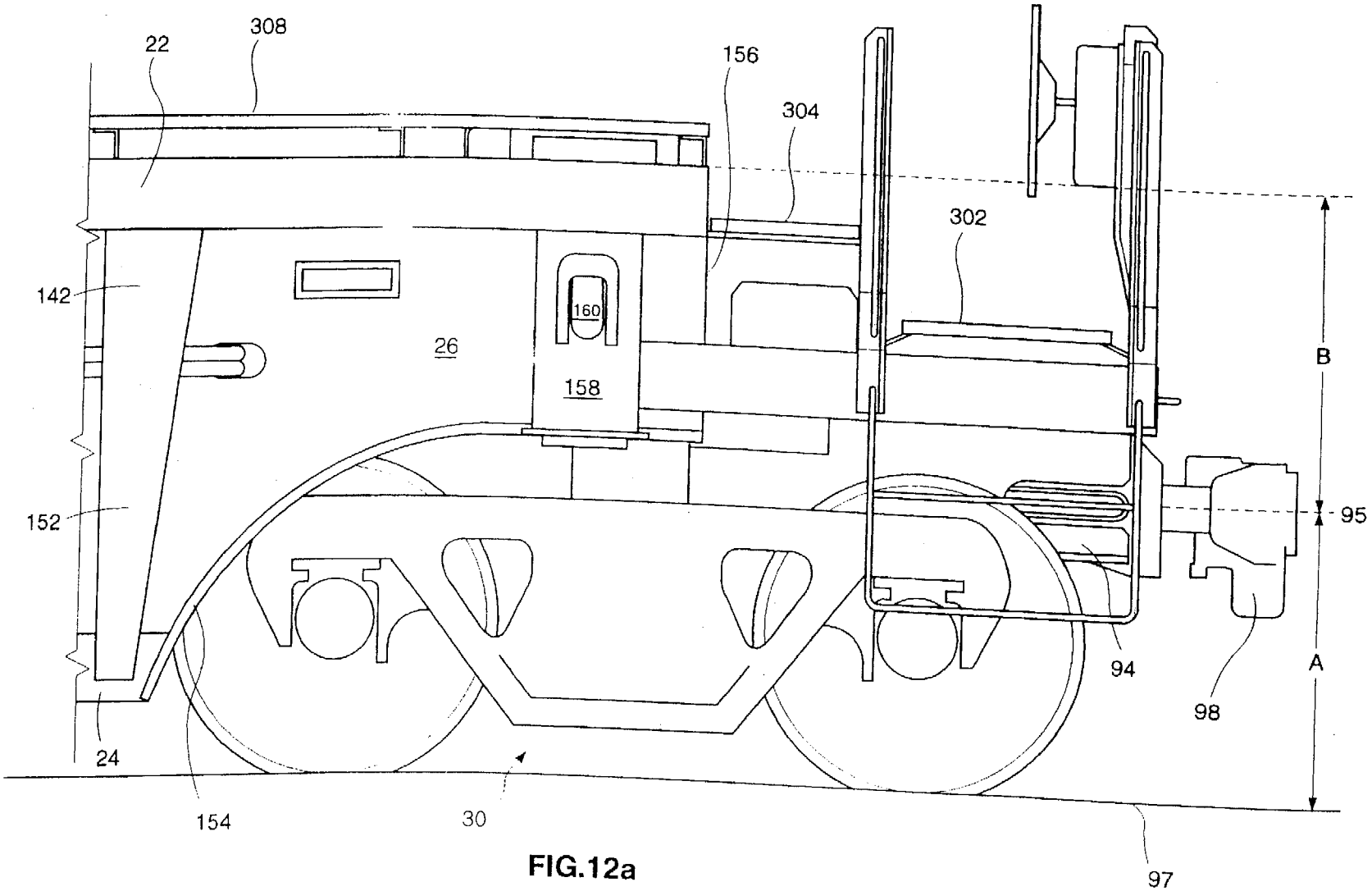
FIG. 12*a* is a detailed side elevational view of one end of the railroad car of FIG. 1, similar to the view of FIG. 2.
Figure 12B:
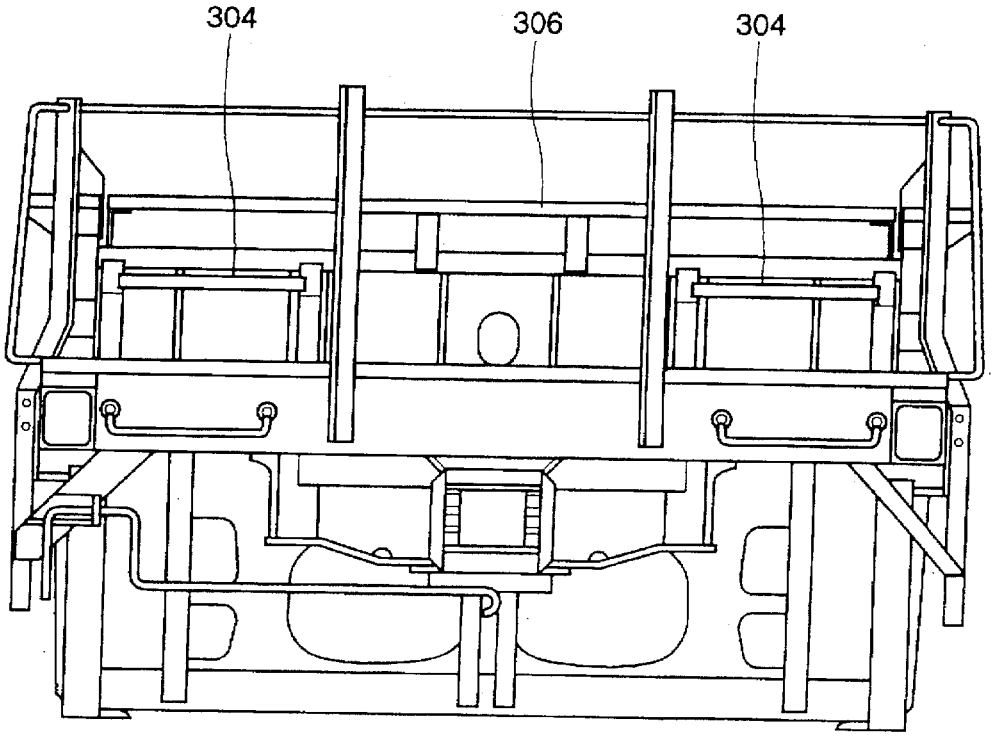
FIG. 12*b* is an end elevational view of the railroad car as depicted in FIG. 12*a;*

Referring to FIGS. 9, 10*a*, 10*b*, 11 and 12*a*, one end structure 28 is more particularly illustrated. Both end structures 28 of the car 20 are identical. For simplicity, only one end is illustrated. The end structure 28 is located at one end of the car 20, as is shown in FIG. 12*a*. Each end structure 28 comprises a first transversely disposed structural member 90 (FIGS. 10*a*, 10*b* and 11), a second transversely disposed structural member 92 (FIGS. 10*b* and 11), a stub centre sill 94 (FIGS. 9 and 10*b*), an inboard bulkhead 32 (FIGS. 9 and 10*b*), and a horizontally disposed shear plate 96 (FIGS. 10 and 10*b*). In the preferred embodiment, the first and second transversely disposed structural members 90 and 92 are an upper bolster and a lower bolster respectively.

As is best shown in FIG. 10*b*, the stub centre sill 94 extends from a coupling means 98, (for coupling the car 20 to another railroad car) to the bulkhead 32, and is the main draft load connection between adjacent railroad cars. One example of such coupling means is a standard yoke and coupler connector. Referring now to FIG. 12*a*, the centre sill 94 defines a draft centerline 95 positioned above the railhead 97 (shown schematically) at a predetermined height A. The coupling means 98 at the end of the car 20 is mounted in the outboard end of the stub centre sill 94 (FIGS. 10*b* and 12*a*). The inboard end of the stub centre sill 94 nearest the bulkhead 32 is tapered, as shown in FIG. 10*a*, to improve access to the inboard wheels and brakes on the truck 30 for inspection and wheel gauging. The stub centre sill 94 includes a pair of spaced apart vertical side plates 100 (FIGS. 9, 10*a* and 10*b*), a bottom plate 102 (FIGS. 9 and 10*b*), and a top plate 104 (FIGS. 9 and 10*b*). Top plate 104 is integral with the shear plate 96. In the preferred embodiment, the shear plate 96 is the top plate 104 of the stub centre sill 94, as is shown in FIG. 10*b* and as described below. As shown in FIGS. 9, 10*a* and 10*b*, the inboard end of the stub centre sill 94 is joined to the bulkhead 32 by vertical angle stiffeners 106 which are welded to the bulkhead 32 and the inboard end of the stub centre sill side plates 100.

As is best shown in FIG. 10*a*, the horizontally disposed shear plate 96 is substantially planar and extends laterally between the side structures 21, to connect to the respective sidewalls 26 thereof. The shear plate 96 has an upper surface to which the upper bolster 90 is attached, and a lower surface forming a top surface of the stub centre sill 94. The outer peripheral edges of the shear plate 96 define overhanging extensions that project longitudinally beyond the outer edge of the upper bolster 90 and laterally beyond the stub centre sill side plates 100 with a large transition curve 99 between the two extensions of the shear plate. A diagonal stiffening member 107 shown in dotted lines in FIG. 10*a* is provided near each transition curve.

Referring to FIG. 10*b*, the shear plate 96 has an inboard terminal edge from which an upper terminal edge of the inboard bulkhead 32 depends. Shear plate 96 is integral with bulkhead 32 in the preferred embodiment. In the preferred embodiment, bulkhead 32 is a continuation of shear plate 96, wherein the inboard lateral edge of shear plate 96 extends rearwardly and downwardly to merge with the upper portion 108 of the bulkhead 32.

The bulkhead 32 is substantially planar and extends laterally between the side structures 21 to connect to the respective sidewalls 26 thereof. Bulkhead 32 extends downwardly from its upper portion 108 to a point just slightly below the top edge 110 of the vertical leg 54 of the bottom side chord 24 (FIG. 10*b*). The bulkhead 32 has two large access holes 112 therein (FIG. 11) so that a user can access the inboard areas of the truck 30. In addition, the bulkhead 32 also has footholds 114 therein to provide a user with easier access into and out of the well of the car 20 (FIG. 11). Bulkhead 32 is oriented at a slight angle away from the vertical (FIG. 10*b*) to provide some additional clearance between the bulkhead and the ends of containers located in the well portion of the car 20 (not shown). This additional clearance is required so as to accommodate any outward bulging of the end wall of a container in the well and to prevent any door hardware attached to the container end from catching the edges of the access holes 112 or footholds 114. Welded along the lower lateral edge of the bulkhead 32 is a bulkhead bottom flange 38 which is an angle member 116 (FIG. 10*b*). As shown in FIG. 10*b*, angle member 116 has a vertical leg 118, which is joined to the lower lateral edge of the bulkhead 32, and horizontal leg 120 which projects away from the end structure 28 of the car 20. The horizontal leg 120 provides a sill on which diagonal member 42 can rest.

As previously mentioned, vertical angle stiffeners 106 are welded to the bulkhead 32 and the inboard end of the stub centre sill 94 (FIGS. 9, 10*b* and 11). The purpose of the vertical angle stiffeners 106 is to transfer the shear loads from the stub centre sill 94 to the bulkhead 32. Further vertical angle stiffeners 122 (FIG. 11) are joined to the bulkhead 32 and near the sidewalls 26 of the car 20 to stiffen the bulkhead 32 against damage such as denting caused by containers as they are being placed within the well of the car 20.

The upper bolster 90 extends laterally for the width of the car 20 (FIG. 11). The upper bolster 90 comprises a single laterally extending vertical plate 124 (FIGS. 10*a* and 11). Vertical spaced apart plates 128 and vertical pressings 130 are joined to both front and rear faces of the vertical plate 124 such that the upper bolster 90 is symmetric about the vertical plate 124. Vertical member 124 extends laterally between the sidewalls 26 of the car 20 (FIG. 10*a* and 11). The lower lateral edge 132 of the vertical plate 124 is joined to the shear plate 96 (FIG. 10*b*). The upper lateral edge 134 of the vertical plate 124 is joined to the top flange 126, which is joined at its ends to top side chords 22 (FIGS. 10*a* and 11). The uppermost surface of each top side chord 22 is positioned above the draft centerline at a height B shown in FIG. 12*a*. The vertical edges of vertical member 124 are joined to the sidewalls 26 of car 20 (FIG. 10*a*). In the preferred embodiment, a ratio defined by A, which is the height of the draft centerline above the railhead, divided into B, which is the height of the uppermost surface of each top side chord 22 above the draft centerline, is greater than approximately 1 (refer to FIG. 12*a*).

Unlike upper bolster 90, lower bolster 92 is a stub bolster in that it does not extend for the width of the car 20 (FIG. 11). Lower bolster 92 includes a vertical plate 136 which is substantially co-planar with vertical plate 124 of the upper bolster 90 (FIGS. 10*b* and 11). Joined to the lower edge of the lower bolster 92 is a flange 138 which is transverse to, and integral with, an intermediate section of the stub centre sill 94 (FIG. 11). Vertical pressings 140 are joined to both the front and rear faces of the vertical plate 136 of the lower bolster 92 and are aligned with vertical pressings 130 of the upper bolster 90 (FIG. 11). Vertical pressings 140 are joined at their bottom edges to flange 138 and at their top edges to shear plate 96.

As is best illustrated in FIGS. 1, 3, 12*a* and 12*b*, each end structure has a particular platform arrangement 300 to facilitate access to the well of the car and the containers placed therein.

The platform arrangement comprises a laterally extending generally horizontal first platform 302 at the outboard end of each stub centre sill 94. The platform 302 extends for the full width of the car 20. The platform 302 is disposed at a height intermediate of that of the shear plate 96 and that of the top flange 126 of the upper bolster 90.

The platform arrangement also comprises two substantially similar, generally horizontal platforms 304 disposed in a flanking relationship relative to the stub centre sill 94 which laterally is considerably narrower than the first platform 304. The platforms 304 are disposed at a height intermediate of that of the first platform 302 and the upwardly facing surface of the top flange 126 of the upper bolster 90.

The platform arrangement also comprises a third generally horizontal platform 306 which is similarly dimensioned to the first platform 302 in the preferred embodiment and extends for the full width of the car 20 over the top flange 126 of the upper bolster 90. The third platform 306 is joined at each of its lateral ends to a side platform 308. Each side platform 308 sits atop the corresponding top side chord 22 and extends longitudinally from the outboard longitudinal end of top side chord 22 to a point approximately adjacent to the longitudinal outermost transverse member 34. The third platform 306 is co-planar with each side platform 308. As is best shown in FIGS. 1 and 3, there are steps 310 descending from the third platform 306 to the shear plate 96. There are footholds 114 in the bulkhead 32 to provide a user with easier access into and out of the well of the car 20. The platform, step and foothold arrangement is the subject of a co-pending application filed concurrently herewith, and assigned to the same applicant herein.

The described end structure is designed for transferring draft and buff forces from the stub centre sill 94 to the shear plate 96, and from the shear plate 96 to the top side chords 22, bottom side chords 24 and sidewalls 26. In addition, the end structure is also designed so that it transfers the reactive moment to the draft moment created by an applied axial force at the stub centre sill 94 and the equal and opposite reaction force at the shear plate to the sides of the car 20. The described end structure is also intended to transfer shear in the sidewalls 26 created by the vertical loads at the container support container support brackets 62 from the sidewalls 26 to the vertical plate 124 in the upper bolster 90. A portion of the vertical shear in the upper bolster 90 is diverted to the lower bolster 92, and then to the centre stub sill 94 and then into the truck 30 through a conventional centre plate (not shown) on the bottom surface of the stub sill.

(c) Side Structures

Figure 13:
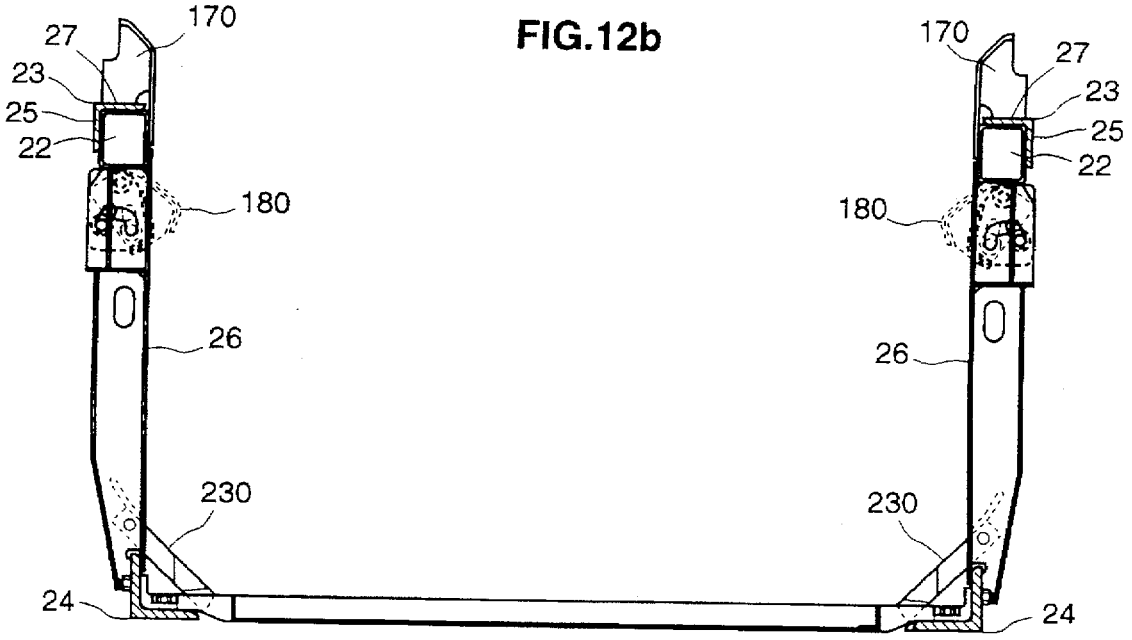
FIG. 13 is a sectional view of the railroad car of FIG. 1, taken along view line 13—13 of FIG. 2.

Side structures 21 comprise top side chords 22, bottom side chords 24 and sidewalls 26. As is best shown in FIG. 13, top side chord 22 is a hollow, straightline structural tube of rectangular cross-section. As is best shown in FIG. 1, sidewalls 26 are generally planar. In the preferred embodiment the sidewalls may be constructed with plates or sheets, depending on the loading characteristics of the particular portion of the sidewall structure, as will be appreciated by those skilled in this art. Rather than increasing the thickness of the various structural members in the car (which although resulting in a relatively strong railcar, would also result in a railcar having a relatively high tare weight) the height of the side structures has been increased.

Referring to FIG. 13, the upper edges of sidewalls 26 are connected to the inward vertical surface of top side chord 22 by a weld connection. As illustrated in FIG. 13, each top side chord 22 is reinforced with an angle member 23, having a vertical leg 25 and a horizontal leg 27. The vertical leg 25 is welded to the outer longitudinal surface of the top side chord 22. The horizontal leg 27 is welded to the top surface of the top side chord 22 for the maximum contribution to section. The lower edges of sidewalls 26 are joined to the inside surface of vertical leg 54 of bottom side chord 24 (FIGS. 6*a*, 6*b* and 6*c*). As is best shown in FIG. 2, the sidewalls 26 are reinforced by vertically disposed major side members 142, 144 and 146 and minor side members 148. Major side members 144 and minor side members 148 are U-pressings, each of which is welded to the underside of the top side chord 22 and to sidewall 26. That is, the free terminal longitudinal edges of each side member 144 and 148 are attached to the planar sidewall 26, while the upper edge is attached to the underside of the top side chord 22. Minor side members 148 have the same lateral depth as major side members 144, but are narrower than major side members 144. Major side members 146 are angle members each having a web substantially normal to the sidewall 126 and a flange substantially parallel to the sidewall 26 (FIG. 1).

Referring to FIG. 9, major side member 142 comprises a vertically disposed web 150 (shown in dotted lines in FIG. 9) located adjacent the bulkhead 32 and being substantially co-planar therewith. The web 150 extends laterally outwardly of the car 20 longitudinally between the top side chord 22 and bottom side chord 24 to connect at each end therewith. The web 150 is connected to the sidewall 26 along an inwardly facing longitudinal edge of the web. Joined to the outwardly facing longitudinal edge of the web 150 and substantially parallel to the sidewall 26 is a generally vertically disposed tapered flange 152 (FIG. 9). The upper terminal end of tapered flange 152 is connected to the top side chord 22. Tapered flange 152 is wider at its upper end than its lower end. Major side member 142 is designed to act as a wide flanged beam wherein the sidewall 26 is the first flange of the beam, web 150 is the web of the beam and tapered flange 152 is the second flange of the beam.

A one piece curved bottom flange 154 (FIGS. 9 and 12*a*) extends inwardly from the bottom of the front vertical edge 156 of the sidewall 26 to the front edge of bottom side chord 24. Bottom flange 154 is curved such that it is positioned several inches above the top of the side frame of the truck 30, as is shown in FIG. 12*a*, so that a user can easily access the wheels and brake shoes of the truck 30 from the side of the truck 30. The curved bottom flange 154 also facilitates inspection and maintenance of the truck 30 by a user. In addition, because the flange 154 is continuous in curvature and does not introduce stress risers associated with geometric discontinuity, it is expected to enhance the fatigue resistance of the areas of the railcar end structure which are immediately adjacent the flange. The curved bottom flange is the subject of a co-pending U.S. application filed concurrently herewith, and assigned to the same applicant herein.

Referring to FIGS. 9 and 12*a*, a short side member 158 comprising a U-pressing with a reinforced opening 160 suitable for the installation of a conventional towing cable hook (not shown) is located near the vertical edge 156 of the sidewall 26. The short side member 158 is welded to the underside of the top side chord 22 and to the sidewall 26. Short side member 154 has a bottom plate 162 (FIG. 9) which is integral with curved bottom flange 154. Bottom plate 162 has an opening (not shown) suitable for the installation of a conventional lifting cable hook (also not shown).

The described side structure is noteworthy for its ability to carry sizable vertical loads and react the buff and draft loads applied at the stub centre sill 94. The vertical loads cause top side chords 22 to be in compression, the bottom side chords 24 to be in tension and the sidewalls 26 to be in shear.

Major side member 142 is designed to enhance the buckling resistance of top side chord 22 under compressive loads. Major side member 142 acts to reduce the unsupported length of the top side chord 22 and thereby increases its buckling strength. In addition, major side member 142 is expected to increase the torsional stiffness of top side chord 22 at the bulkhead 32. The other major side members 144, 146 and 148, because they are welded to the underside of top side chords 22 and to the sidewall 26 have inherently high torsional stiffness, thereby creating a stiff connection between the load-supporting transverse members 34 and top side chords 22. In simplified terms, the bending stiffness of the load-supporting transverse members 34 is therefore effectively "transferred" via the major side members 144, 146 to the top side chord 22, thus increasing its buckling strength.

The sidewall 26 carries the vertical loads in shear. The minor side members 148 and the major side members 142, 144 and 146 effectively "divide" each sidewall 26 into shorter panels. This increases the stiffness of the sidewall 26.

(d) Container Guides and Other Miscellaneous Features

The well space defined by the two end structures 28 and the two sidewalls 26 can be dimensioned to hold a lower container arrangement consisting of one of a 40-foot, 45-foot or 48-foot long bottom container or two 20-foot containers. An upper container, namely one of a 40-foot, 45-foot, 48-foot or 53-foot long container, or two 20-foot long containers, can be positioned on top of the lower container arrangement to form a double-stacked container load.

Figure 14:
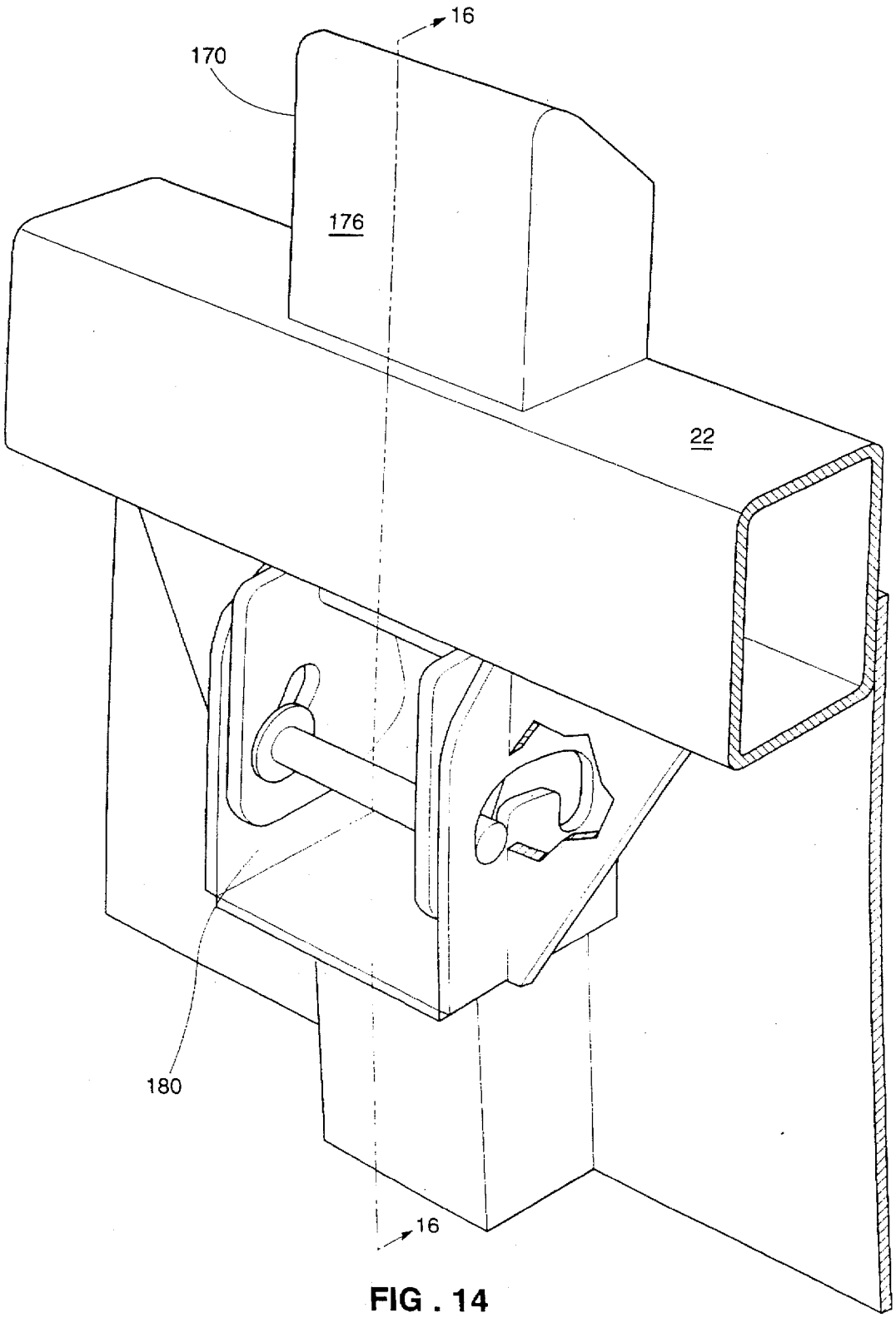
FIG. 14 is a perspective view of a fixed lateral guide and a retractable guide assembly for the railroad car of the present invention.

The containers are loaded into the well by an operator. As the containers are relatively large and difficult to position, in the preferred embodiment, there are a plurality of pairs of container guides on the freight car 20 which assist the operator locate the containers in the well. Pairs of fixed lateral guides 170 (FIG. 1) are the primary guides. As shown in FIG. 11, one member 170A of the pair is located on the top of one of the top side chords 22. The other member 170B, shown in FIG. 11 is positioned laterally opposite the first member 170A, on the top of the other top side chord 22. Each member 170 has two longitudinally spaced sidewalls having inwardly sloping upper edges connected by a contoured plate top 176 (FIG. 14). Each member 170 has an upper surface which is inwardly sloping (FIG. 14). The width defined the inside faces of the fixed lateral guides 170 is the same as the width of the well, which in the preferred embodiment is 8 feet, 8 inches (FIG. 13).

Figure 16:
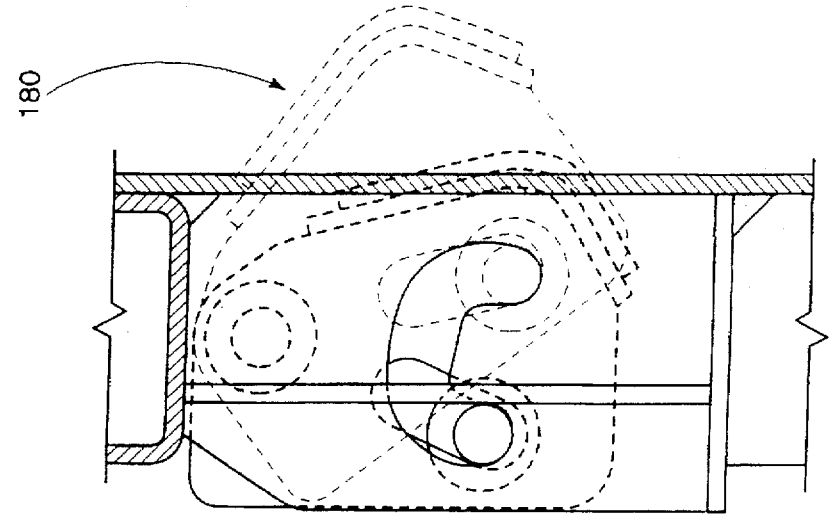
FIG. 16 is a sectional view of the retractable guide assembly of FIG. 14, taken along view line 16—16 of FIG. 15.
Figure 15:
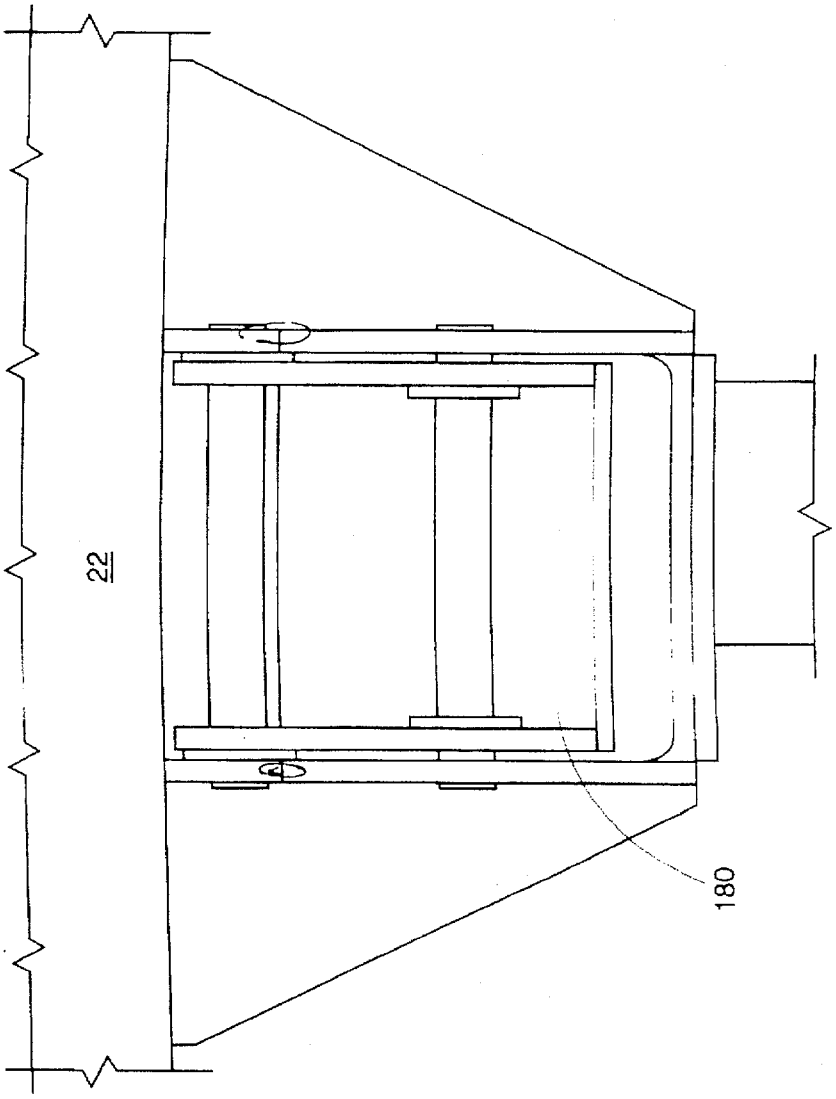
FIG. 15 is a side elevational view of the retractable guide assembly shown in FIG. 14, taken from outside the car.

Standard intermodal cargo containers are designed to have a width of either 8 feet or 8.5 feet. In order to accommodate either standard width, the car 20 includes the retractable guide assemblies best illustrated in FIGS. 13, 14, 15 and 16. In the preferred embodiment, the guide assembly 180 is located in the sidewall as is best shown in FIG. 14, below the bottom surfaces of top side chord 22 within the reach of the typical operator of average height standing on the ground. The guide assembly 180 is manually operated and can be moved about a pivot between a retracted position and an extended position. When the guide assembly is in the extended position, as shown in FIG. 16 in dotted lines, the effective width of the well is reduced so as to accommodate an intermodal cargo container having a width of 8 feet. Examples of a retractable guide assembly suitable for use with the present invention are disclosed in the co-pending U.S. patent applications of Butcher et al. filed on Apr. 8, 1994 under Ser. No. 08/225,383, now U.S. Pat. No. 5,520,489, and on Mar. 31, 1995 under Ser. No. 08/414,085, now U.S. Pat. No. 5,501,556. Narrower cargo containers will abut against the guides. When the adjustable container guides are in the retracted position as shown in FIG. 15, the width of the well accommodates cargo containers having a width of 8.5 feet. In addition to helping guide the containers into position and onto the locating cones 88 on the container support container support bracket 62, the guide assembly 180 provides lateral roll support for the containers.

Figure 17:
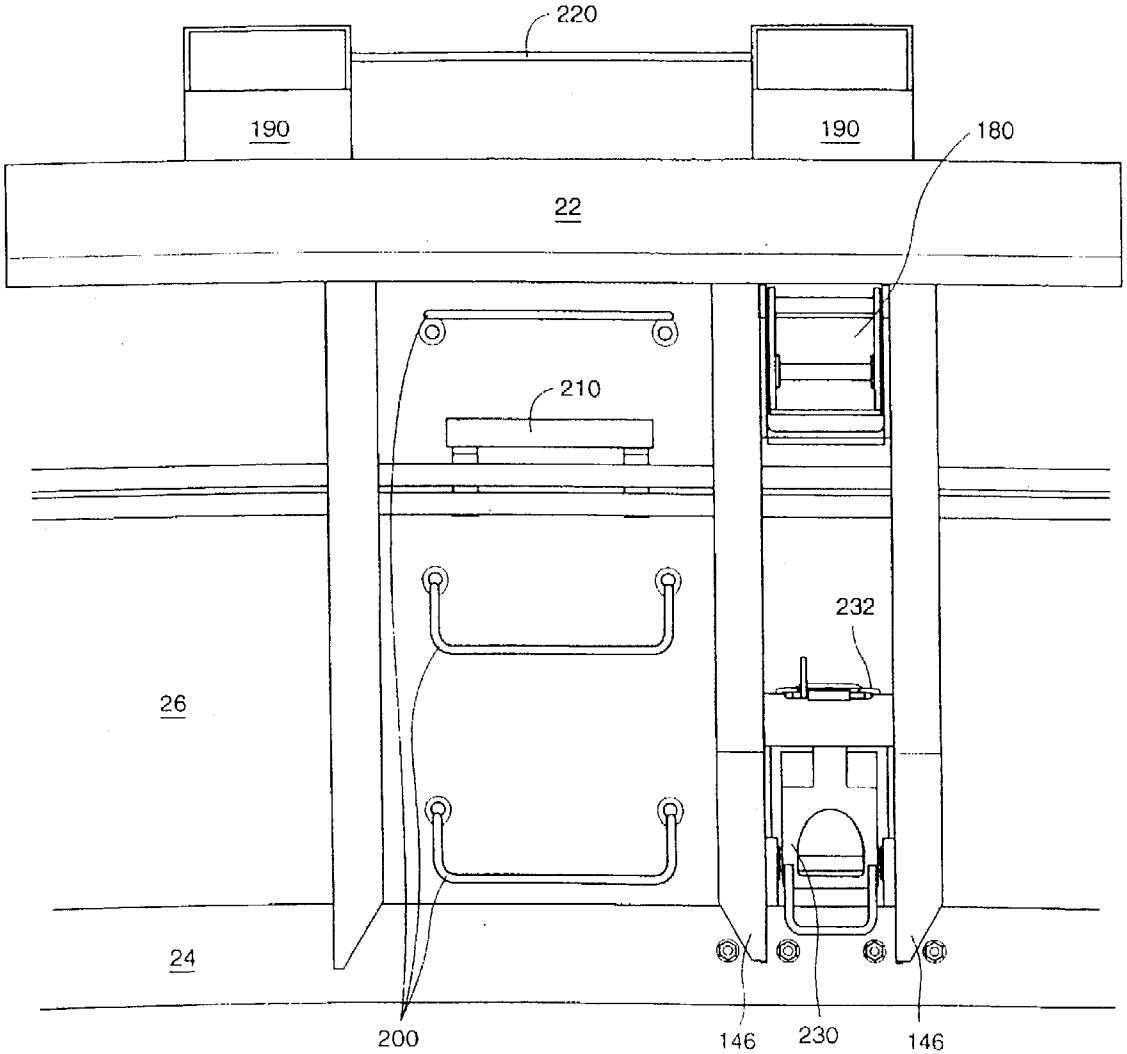
FIG. 17 is a detailed side elevational view of a central portion of the railroad car of FIG. 1.

Furthermore, in the preferred embodiment, car 20 includes pivotable container stops 230, as best illustrated in FIGS. 13 and 17. A pivotable container stop 230 is mounted in each of the sidewalls 26, near the bottom side chord 24. Each pivotable container stop 230 is located adjacent to the centre load supporting transverse member 44. Each pivotable container stop 230 comprises an elongate bar which can be moved about a pivot between a retracted position and an extended position. Pivotable container stops 230 are only used when two 20-foot containers form the bottom layer of containers in the well of the car 20. The pivotable container stops 230 are located such that they are disposed between the two 20-foot containers. An operator loading a 20-foot container into the well of the car 20 must ensure that the first 20-foot container is placed into the well such that the second 20-foot container can be placed in the well adjacent to the first. Pivotable container stops 230 assist an operator in locating the two 20-foot containers longitudinally.

In addition, once the containers are loaded, pivotable container stops 230 help prevent the containers from translating longitudinally within the well of the car 20, once the car 20 is put in motion. Pivotable container stops 230 can be moved manually between the retracted position and the extended position. In the retracted position shown in FIG. 17, the pivotable container stop 230 does not protrude into the well of the car 20, but is maintained in an upright position. A latch 232 maintains the pivotable container stop 230 in this upright position. Upon disengagement of the latch 232, the pivotable container stop 230 can be moved to its extended position as shown in FIG. 13. In the extended position, a portion of container stop 230 protrudes into the well of the car 20. The pivotable stop and latch assembly is the subject of co-pending U.S. application filed concurrently herewith and assigned to the same applicant herein.

Spaced about the perimeter of the well of the freight car 20 on the top of top side chords 22 are fixed storage boxes 190 shown in FIG. 1. Each of these storage boxes slope downwardly and inwardly and also serves as a fixed container guide for guiding the containers into the well. Fixed storage boxes 190 can be used to store interbox connectors for connecting containers in the first tier with containers in the second tier. Such connectors are well known to those skilled in this art.

In addition, in the preferred embodiment, at the centre of the car 20 on each side thereof (FIG. 17), there are footholds, preferably in the form of ladder rungs 200 and a step 210 to provide convenient access to the tops of the bottom containers when placed in the well of the car 20. There is also a horizontal hand grab 220 extending between adjacent fixed storage boxes 190 which provide an operator standing on a ladder rung 200 with hand support.

Those persons skilled in this art will readily appreciate that various modifications of detail may be made to the preferred embodiment discussed and illustrated herein, all of which come within the spirit and scope of the present invention.

We claim:

1. A railroad freight car for transporting intermodal cargo containers, the railroad freight car comprising: a structural frame having spaced apart side structures, opposing end structures and a floor structure, the side structures each having a top member and a bottom member extending longitudinally between the opposing end structures, the top and bottom members of each side structure being disposed in a spaced apart relationship, the floor structure being disposed to extend between the respective bottom members of each side structure, the end structures each providing an inboard bulkhead, such that the side structures, floor structure and bulkheads together define a well for receiving an intermodal cargo container, the end structure further providing a longitudinally disposed stub centre sill having an outboard end for receiving a coupling means for coupling the railroad freight car to another railroad car, the centre sill defining a draft centerline positioned above a railhead at a predetermined height A measured from the railhead to the draft centerline, the end structure having a transversely disposed structural member connected to each of the top members of the side structures, an uppermost surface of each of the top members being positioned above the draft centerline at a height B measured from the draft centerline to said uppermost surface, and wherein a ratio defined by the said height B divided by the said height A is at least.

2. The railroad freight car according to claim 1, wherein the ratio is less than or equal to approximately 1.25.

3. The railroad freight car according to claim 2, wherein the ratio is approximately equal to 1.125.

4. The railroad freight car according to claim 1, wherein the top members and the bottom members of the side structures are each elongate straightline chords.

5. The railroad freight car according to claim 4, wherein the top and bottom elongate chords of each side structure are disposed in a substantially parallel relationship.

6. The railroad freight car according to claim 5, wherein the top chords each have a generally rectangular cross-sectional configuration.

7. The railroad freight car according to claim 6, wherein each side structure further comprises a plurality of generally vertically disposed members connected between the top and bottom chords thereof, and a planar sidewall connected to a vertical surface of each of said top and bottom chords which faces inwardly of the railroad freight car.

8. The railroad freight car according to claim 7, wherein the vertically disposed members of the side structures are generally U-shaped channels whose free terminal longitudinal edges are attached to the planar sidewall.

9. The railroad freight car according to claim 8, wherein the planar sidewall is a plate.

10. The railroad freight car according to claim 8, wherein the transversely disposed structural member is an upper bolster.

11. The railroad freight car according to claim 10, wherein the end structure further comprises a horizontally disposed shear plate, the shear plate extending between the side structures and connecting to the respective sidewalls thereof, the shear plate having an upper surface to which the upper bolster is attached and a lower surface forming a top surface of the centre sill, an upper terminal edge of the inboard bulkhead of the end structure depending from an inboard terminal edge of the shear plate, the inboard bulkhead being substantially planar and extending between the side structures to connect to the respective sidewalls thereof, and wherein each side structure provides a generally vertically disposed web located adjacent each bulkhead and being substantially co-planar therewith, the web extending laterally outwardly of the railroad freight car and longitudinally between the top and bottom chords of the side structure to connect at each end therewith, the web being connected to the sidewall along an inwardly facing longitudinal edge of the web, each side structure further providing a generally vertically disposed flange connected to the outwardly facing longitudinal edge of the web, the flange having one terminal end thereof connected to the top chord.

12. The railroad freight car according to claim 11, wherein the railroad freight car is provided with a 110 ton railroad truck for each of the end structures thereof.

13. The railroad freight car according to claim 12, wherein the railroad freight car has a tare weight of less than approximately 70,000 pounds.

14. The railroad freight car according to claim 13, wherein the railroad freight car has a tare weight of approximately 60,600 pounds.

15. The railroad freight car according to claim 14, wherein the railroad freight car has a net load-carrying capacity of at least approximately 225,000 pounds.

16. The railroad freight car according to claim 5, further comprising a container guide which is moveable between a retracted position and an extended position, the retracted position being located outside of the well, the extended position being located within the well to thereby reduce an effective width thereof, the container guide being mounted in a said side structure below a said top elongate chord and within reach of an operator standing on ground.

17. The railroad freight car according to claim 5, further comprising footholds to provide access to a top of a container placed in the well of the railroad freight car, the footholds being located generally centrally of the railroad freight car on an external side thereof.

* * * * *

UNITED STATES PATENT AND TRADEMARK OFFICE

CERTIFICATE OF CORRECTION

PATENT NO. : 5,730,063
DATED : March 24, 1998
INVENTOR(S) : James Wilfred Forbes and Ilario A. Coslovi It is certified that error appears in the above-identified patent and that said Letters Patent is hereby corrected as shown below:

In column 13, line 36, after "at least" insert ---1--.

Signed and Sealed this

Fifteenth Day of September, 1998

*Attest:*

Bruce Lehman

BRUCE LEHMAN

*Attesting Officer*

*Commissioner of Patents and Trademarks*